US009439525B1

(12) United States Patent
Altman

(10) Patent No.: US 9,439,525 B1
(45) Date of Patent: Sep. 13, 2016

(54) STACKABLE CUP WITH PLATE CUT-OUT

(71) Applicant: Michael Altman, Marietta, GA (US)

(72) Inventor: Michael Altman, Marietta, GA (US)

( * ) Notice: Subject to any disclaimer, the term of this patent is extended or adjusted under 35 U.S.C. 154(b) by 0 days.

(21) Appl. No.: 15/130,099

(22) Filed: Apr. 15, 2016

(51) Int. Cl.
*B65D 6/28* (2006.01)
*A47G 19/23* (2006.01)
*A47G 19/08* (2006.01)

(52) U.S. Cl.
CPC ..... *A47G 19/23* (2013.01); *A47G 19/08* (2013.01)

(58) Field of Classification Search
CPC ..... B65D 1/265; Y10S 229/904; A47G 23/0225; A47G 19/04
USPC ..... 220/4.22
See application file for complete search history.

(56) References Cited

U.S. PATENT DOCUMENTS 2,411,864 A 12/1946 Birkin
2,512,963 A 6/1950 Peiker
2,719,414 A 10/1955 Davis
2,795,121 A * 6/1957 Pantello ..... A47G 19/04 220/23.83
2,916,180 A * 12/1959 Alger ..... A47G 19/08 211/41.2
3,575,315 A * 4/1971 Rosen ..... A47G 19/16 220/23.83
4,785,959 A 11/1988 Kleiner
4,961,555 A * 10/1990 Egan, Jr. ..... A47G 23/0225 211/41.2
5,110,170 A 5/1992 Boatwright
5,111,960 A 5/1992 Zilliox
5,170,908 A 12/1992 Austin
5,361,932 A * 11/1994 Friedrich ..... A47G 19/04 206/217
5,397,089 A * 3/1995 Kataoka ..... A47G 23/0225 220/23.83
5,421,459 A 6/1995 Mazzotti
5,662,240 A 9/1997 Norris
D393,988 S 5/1998 Rogers
7,360,666 B1 4/2008 Primel et al.
7,503,464 B2 3/2009 McCain
8,573,437 B1 11/2013 Evans
8,985,379 B1 3/2015 Evans
2003/0080127 A1* 5/2003 Gibert ..... A47G 19/04 220/23.4
2009/0120948 A1* 5/2009 Ezzy ..... A47G 23/0225 220/737
2010/0116833 A1* 5/2010 Buchert ..... A47G 19/04 220/669

* cited by examiner

*Primary Examiner* — Shawn M Braden
(74) *Attorney, Agent, or Firm* — Louis Ventre, Jr.

(57) ABSTRACT

A cup includes two compartments in a unitary structure: an upper compartment that holds the liquid drink and a lower compartment that has a configured slot to slide onto the edge of a plate. The upper compartment has an open top-end and a closed bottom-end just like any other cup. The open top-end is larger than the closed bottom-end so as to permit stacking multiple cups together. The lower compartment is connected below the closed bottom-end of the first compartment. The second compartment defines a configured slot or cut-out that is shaped to receive the edge of a plate and contact the bottom of the plate. The cut-out starts with a wide slot at the wall of the cup that transitions to a narrow slot within the cup. The narrow slot is intended for the edge of the plate. The wider slot contacts the bottom of the plate.

4 Claims, 5 Drawing Sheets

STACKABLE CUP WITH PLATE CUT-OUT

TECHNICAL FIELD

In the field of special receptacles, a cup is stackable and compartmented, where one compartment enables filling the cup with a drinkable liquid and another compartment defines a cut-out for receiving a food plate.

BACKGROUND ART

Conference reception attendees, house guests, picnic goers, and party attendees at stand up events often need two hands to juggle a drink and a plate while walking around and perhaps selecting hors d'oeurves and appetizers from servers. This can be disconcerting when a table is not available to hold one of them while using the other. Juggling a plate in one hand and a drink in the other often makes it awkward to greet others at the event.

Also, when two people are socializing at a reception, one using a cup and a plate and the other just using a cup, when one of them needs to go to the restroom or go somewhere without the cup, then the other can hold the two cups on one plate and still be able to eat while the other person is gone without their cup.

Trays and other gadgets that are separate components are sometimes thoughtfully provided by a host so that guests can hold the plate and the cup in one hand. But usually, these separate components are an afterthought and when available are something that needs to be cleaned and put away or are an additional piece of garbage that needs to be disposed of properly.

SUMMARY OF INVENTION

A cup includes two compartments in a unitary structure: a first or upper compartment that holds the liquid drink and a second or lower compartment that has a configured slot to slide on the edge of a plate to free up a hand. The upper compartment has an open top-end and a closed bottom-end just like any other cup. The open top-end is larger than the closed bottom-end so as to permit a second cup similarly configured to be nested therewithin so that they can be easily packaged together and sold.

The second or lower compartment is connected below the closed bottom-end of the first compartment. It can be hollow where only the cup walls are supporting the plate, or the second compartment may be a solid to enhance its strength. In either case, the second compartment houses the configured slot or cut-out that is shaped to receive the edge of a plate and contact the bottom of the plate.

The cut-out is substantially horizontally-oriented with a wide slot at the wall of the cup that transitions to a narrow slot within the cup. The narrow slot is intended for the edge of the plate and may be configured to snuggly grab the plate edge so as to provide a friction fit to the plate. The wider slot contacts the bottom of the plate so that the cup is able to rest on the plate. The wall of the cup at the wider slot may include a friction enhancer extending upward from the wide slot so as to engage the bottom plate surface when the plate is fully inserted in the cut-out.

Technical Problem

A disposable, stackable drinking cup is needed that can securely hold a plate or simply be detachably affixed to the plate to free up a hand.

A cup with a slotted configuration is needed so that multiple cups could securely engage the edge of a plate and be carried in one hand by a server.

A cup with a slotted configuration is needed so that a person placing the cup atop the plate would not be prone to spilling the drink due to instability on the top of tilting plate.

A system of cup and frictionally-affixed plate is needed that does not require a third gadget to hold them.

A system of cup and frictionally-affixed plate is needed so an event sponsor will not have to procure more expensive special plates with recesses, or plates with holes or other special configurations to receive the cup.

A system of cup and frictionally-affixed plate is needed so that a person can eat and drink holding the cup and plate in one hand while eating with the other.

Solution to Problem

The solution is a unitary cup that is both stackable and compartmented where one compartment enables filling the cup with a drinkable liquid and another compartment defines a cut-out for receiving a plate.

Advantageous Effects of Invention

An advantage of a cup with a built in holder slot is that it will not require any other component to hold both the plate and the cup in one hand.

An advantage of a cup with a built in holder slot is that it eliminates other gadgets used for that purpose that either must be cleaned after use or added to the volume of garbage after use.

An advantage of a cup with a built in holder slot is that it does not require a special plate or apparatus on the plate to properly function.

An advantage of a cup with a built in holder slot is that more than one such cup is attachable to one plate. This enables a date or one's spouse to easily attach and carry multiple drinks to a group of friends.

An advantage of a cup with a built in holder slot is that it can be stacked with other cups on top of each other for retail display in stores.

An advantage of a cup with a built in holder slot is that it does not require additional storage space for trays or other gadgets enabling the same function.

An advantage of a cup with a built in holder slot is that it prevents accidental spills from cups that would otherwise easily slip off the plate. An embodiment would not only hold the lip of the plate but also the body of the plate to give it a strong leverage point.

An advantage of a cup with a built in holder slot is that it could be used to hold the plate while just holding the cup.

An advantage of a cup with a built in holder slot is that it could be used to hold the cup while just holding the plate.

An advantage of a cup with a built in holder slot is that wait staff holding a serving tray could hold multiple cups.

An advantage of a cup with a built in holder slot is that multiple cups held on a serving tray would be more stable then on top of the serving tray.

An advantage of a cup with a built in holder slot is that multiple cups may be held on a serving tray while enabling the server tray to simultaneously hold more food for delivery to guests.

An advantage of a cup with a built in holder slot is that once lodged on a food tray, the combination is inherently more stable thus minimizing the potential for spilling the contents of the cup on food on a tray.

BRIEF DESCRIPTION OF DRAWINGS

The drawings illustrate preferred embodiments of the stackable cup with plate cut-out according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
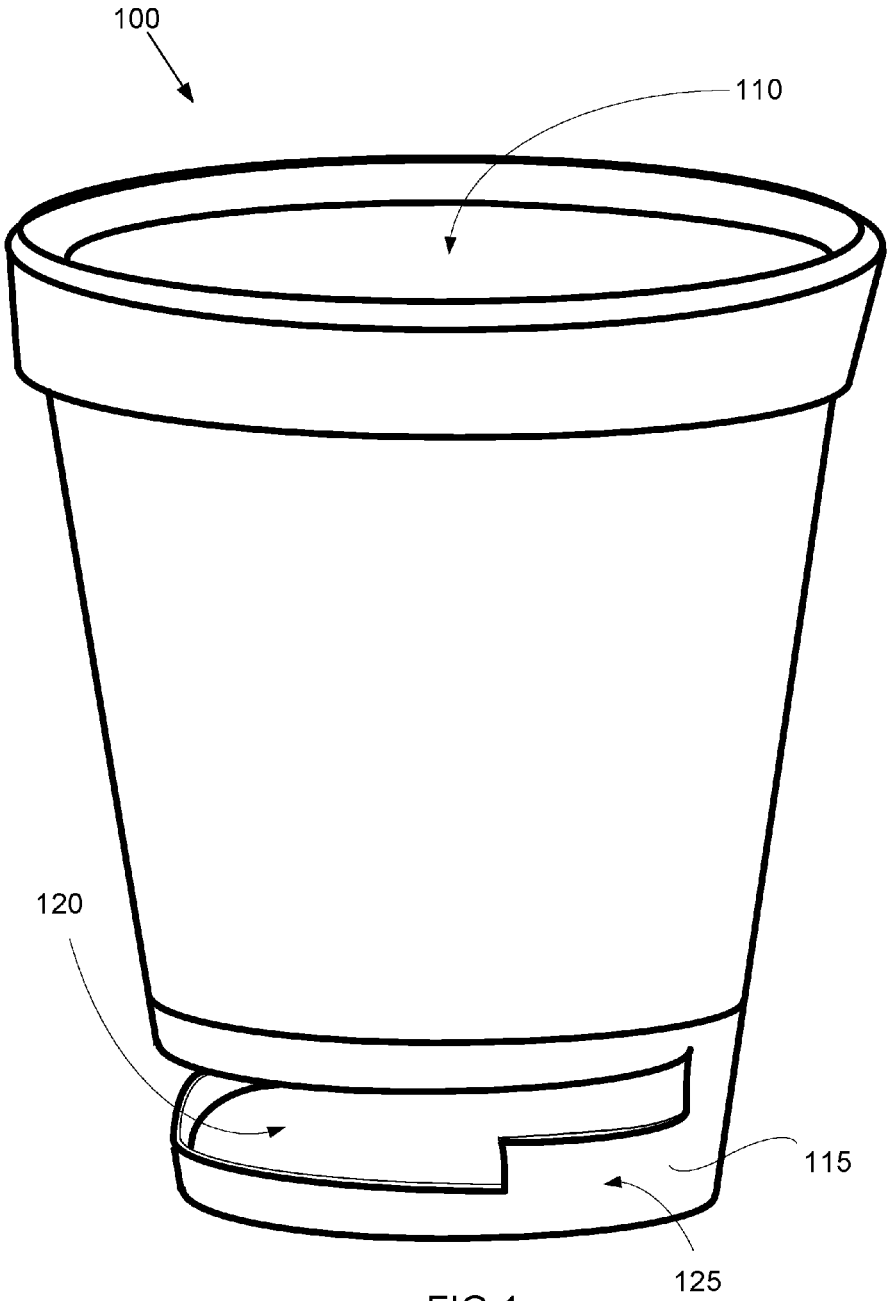
FIG. 1 is a perspective view of a cup showing a cut-out.

FIG. 1 shows a perspective of a cup (100) according to a preferred embodiment as discussed herein. The cup (100) is more or less a standard drinking cup, which may be made of any material with which drinking cups are made, such as for example, paper, plastic or ceramic. The cup (100) is a unitary structure, that is, it exists as one integrated structure with a wall (125), the wall being a single surrounding enclosure. The wall (125) is a common wall that surrounds two compartments: a first compartment (205), and a second compartment (115). The wall (125) makes the cup (100) one inseparable piece and not two separable pieces.

The first compartment (205) has an open top-end (110) and a closed bottom-end (210). The first compartment (205) is where a liquid (215), typically a drinkable liquid such as water, soda or coffee, would be held when the cup (100) is filled. Thus, the first compartment (205) is configured to hold the liquid (215). The shape of the first compartment (205) is also structured so that the entire cup can be stacked within another similarly shaped cup. Thus, the first compartment (205) has the open top-end (110) that is larger than the closed bottom-end (210), which permits a second cup similarly configured to be nested therewithin.

The second compartment (115) is connected to the first compartment (205) below the closed bottom-end (210) of the first compartment (205). The second compartment (115) defines a cut-out (120) that is substantially horizontally-oriented from the wall (125) of the cup (100) when the cup is sitting on a flat surface like a table. The cut-out (120) is configured with a wide slot (220) at the wall (125) of the cup (100) wherein the wide slot (220) transitions to a narrow slot (225) towards the rear of the cut-out (120) within the cup (100). The cut-out (120) is configured to receive an edge (305) of a plate (310) so that the cup (100) is able to rest on the plate (310). The cut-out (120) may be shaped with a narrowing shape from the wall (125) to the rear of the cut-out (120) in order to create a friction surface to hold the plate (310) once the plate (310) is placed within the cut-out (120).

Figure 2:
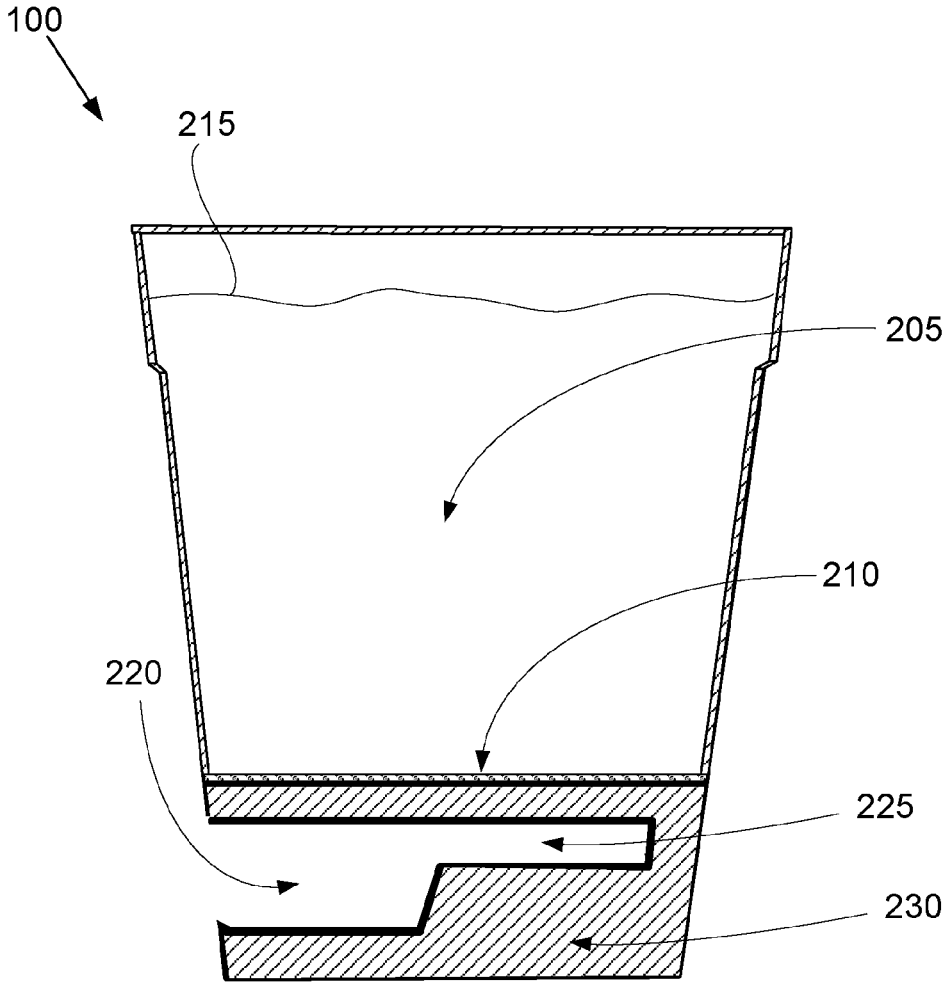
FIG. 2 is a cross-sectional elevation view of a cup with the cut-out.
Figure 3:
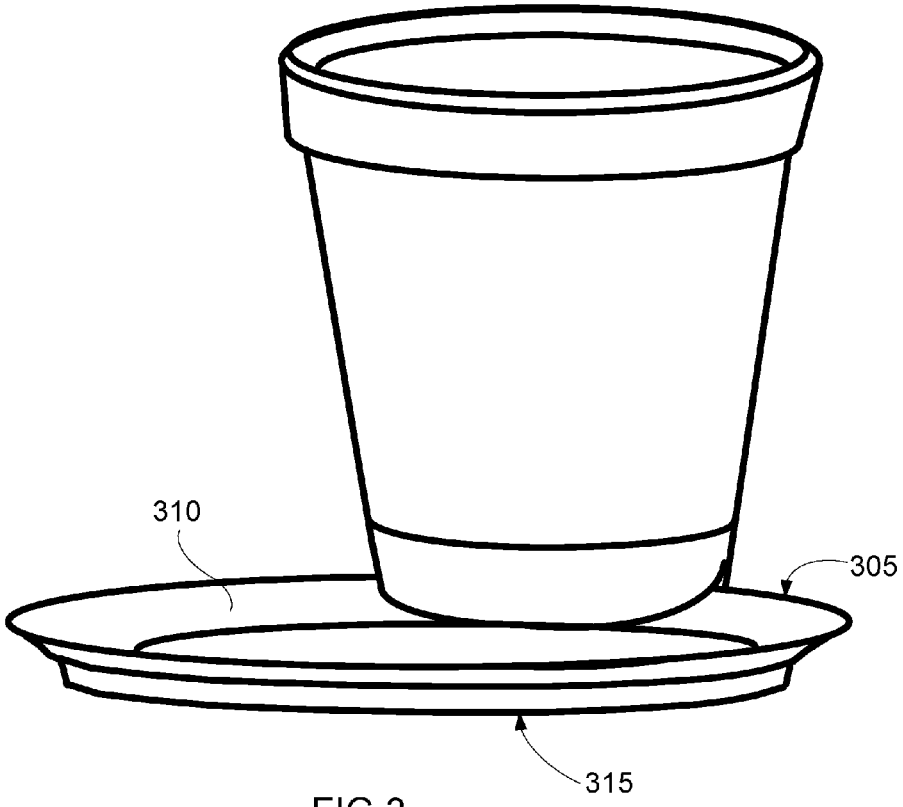
FIG. 3 is a perspective view of a cup and plate.
Figure 4:
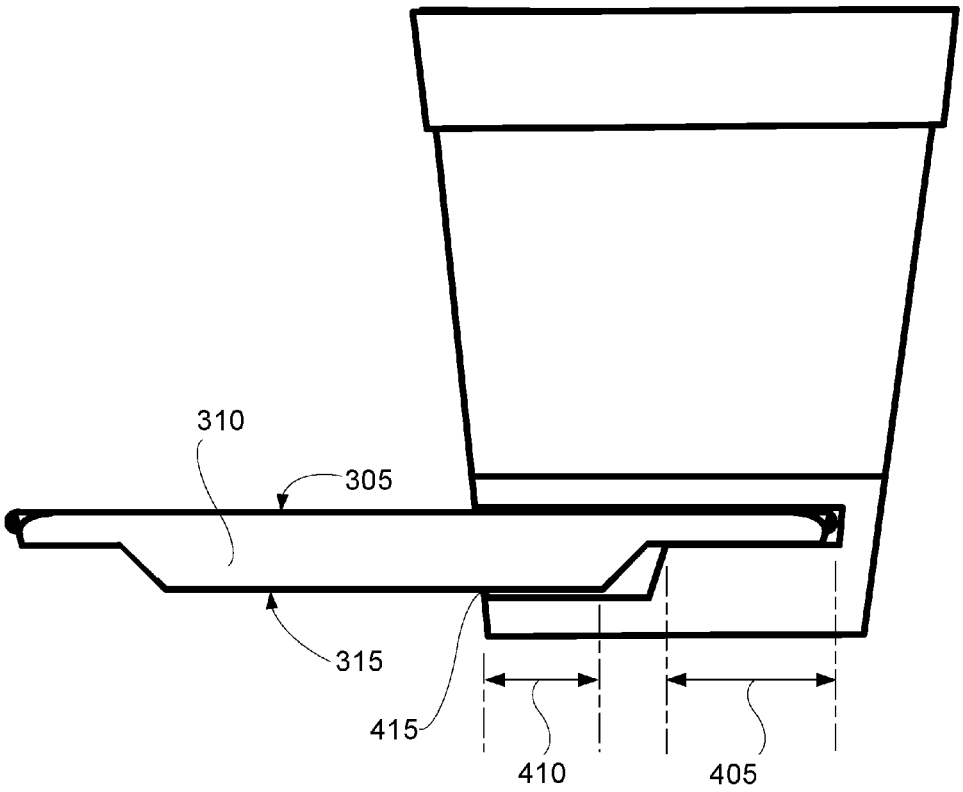
FIG. 4 is an elevation view of a cup and plate.

The second compartment (115) is preferably hollow as shown in FIG. 1 where the wall (125) of the cup (100) is strong enough to hold the cup in place when either the cup (100) or the plate (310) alone is being held. Alternatively, the second compartment (115) may be made of a solid material (230) surrounding the cut-out (120) as shown in FIG. 2. The solid material (230), such as a solid conical section, defines the cut-out and it may be any suitable cup material, such as for example a plastic.

The second compartment (115) may further include a friction enhancer (415), such as a pointed spike or a rubber projection extending upward from the wide slot (220), preferably at the wall (125). The friction enhancer (415) is configured to engage the bottom plate surface (315) when the plate (310) is fully inserted in the cut-out (120) so as to prevent the plate (310) from unintentionally slipping out of the cut-out (120).

When combined with a plate (310), the cup (100) enables a system for eating in a standing position. The system enables carrying the cup (100) and plate (310) in one hand. The system includes the cup (100), as described above, resting on the plate (310) when the plate (310) is inserted into the cut-out (120). The system is thus the cup (100) that defines the cut-out (120) in combination with the plate (310) fitting within the cut-out (120).

The system includes the cup (100). The cup (100) includes a first compartment (205), the first compartment (205) comprising an open top-end (110) and a closed bottom-end (210), the first compartment (205) configured to hold a liquid (215), wherein the open top-end (110) is larger than the closed bottom-end (210) so as to permit a second cup similarly configured to be nested therewithin.

The cup (100) within the system further includes a second compartment (115) connected to the first compartment (205) below the bottom-end of the first compartment (205), the second compartment (115) defining the cut-out (120) to be substantially horizontally-oriented from a wall (125) of the cup (100), the cut-out (120) having a wide slot (220) at the wall (125) of the cup (100), the wide slot (220) transitioning to a narrow slot (225) within the cup (100), the cut-out (120) configured to receive an edge (305) of the plate (310) so that the cup (100) is able to rest on the plate (310).

The system includes the plate (310) comprising a bottom plate surface (315) transitioning to the edge (305) raised above the bottom plate surface (315), the plate (310) configured so that a first portion (405) of the plate (310) beginning at the edge (305) fits within the narrow slot (225) within the cup (100) and a second portion (410) on the plate (310) on the bottom plate surface (315) rests within the wide slot (220) at the wall (125) of the cup (100). The plate (310) is any typical dinner or picnic plate. Thus, for most embodiments, the plate (310) may be described as a dish defining an open, shallow container for holding food.

As described above, the cut-out (120) may be shaped with a narrowing shape from the wall (125) to the rear of the cut-out (120) in order to create a friction surface to hold the plate (310) once the plate (310) is placed within the cut-out. Preferably, at least the narrow slot (225) provides a friction fit of the first portion (405) of the plate (310).

The second compartment (115) may further include a friction enhancer (415), such as a pointed spike or a rubber projection extending upward from the wide slot (220), preferably at the wall (125). The friction enhancer (415) is configured to engage the bottom plate surface (315) when the plate (310) is fully inserted in the cut-out (120) so as to prevent the plate (310) from unintentionally slipping out of the cut-out (120).

Figure 5:
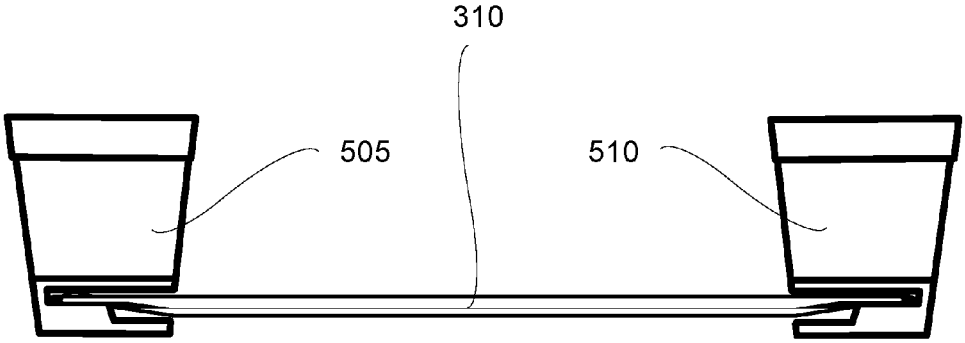
FIG. 5 is an elevation view of two cups inserted onto a plate.

FIG. 5 illustrates an exemplary use of the plate (310) holding two cups: a first cup (505) and a second cup (510).

Figure 6:
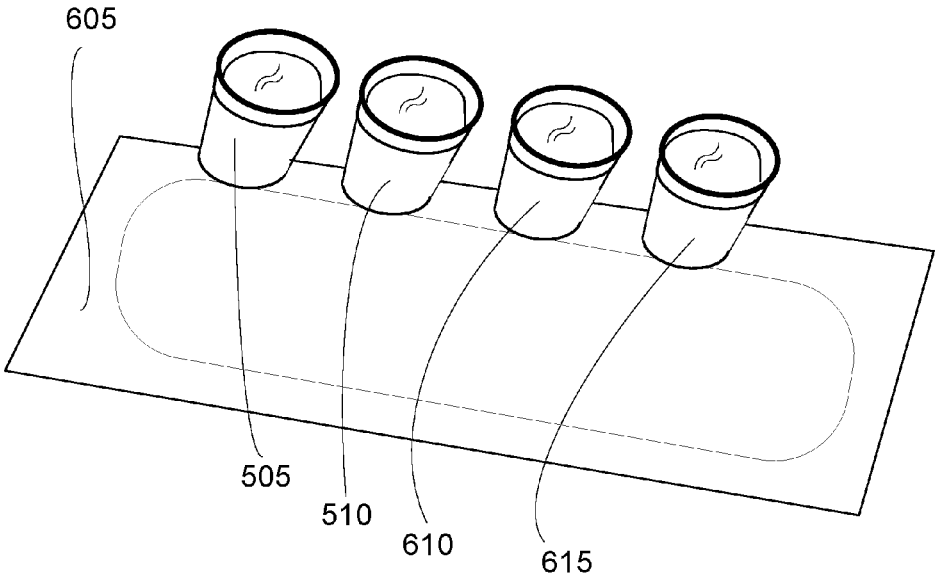
FIG. 6 is a perspective of four cups inserted onto a serving tray.

FIG. 6 illustrates an exemplary use of serving tray (605) holding four cups: the first cup (505), the second cup (510), a third cup (610) and a fourth cup (615).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the food service industry.

What is claimed is:

1. A cup comprising an open top-end and a bottom end, the cup further comprising:

a first compartment, the first compartment extending from the open top-end to a closed bottom-end above the bottom end of the cup, the first compartment configured to hold a liquid, wherein the open top-end is larger than the closed bottom-end so as to permit a second cup similarly configured to be nested therewithin;

a second compartment connected to the first compartment below the closed bottom-end of the first compartment, the second compartment sharing a wall with the first compartment, the wall forming a single surrounding enclosure of the first compartment and the second compartment;

the second compartment defining a cut-out, the cut-out having a wide slot at the wall of the cup, the wide slot transitioning to a narrow slot within the cup, the cut-out configured to receive an edge of a plate so that the cup is able to rest on the plate, the second compartment starting and ending at the wall forming the single surrounding enclosure wherein said wall defines a constant slope through the transition from first compartment to second compartment; and the second compartment comprising a solid material surrounding the cut-out, the solid material circumferentially extending to the wall underlying the closed bottom-end of the first compartment, the solid material being thicker than the closed bottom end of the first compartment, the second compartment configured so that the open top-end is substantially horizontal when the cup is sitting on a flat surface.

2. A system for eating in a standing position, the system comprising a cup defining a cut-out and a plate fitting within the cut-out, the cup comprising:

a first compartment, the first compartment comprising an open top-end and a closed bottom-end, the first compartment configured to hold a liquid, wherein the open top-end is larger than the closed bottom-end so as to permit a second cup similarly configured to be nested therewithin;

a second compartment connected to the first compartment below the bottom-end of the first compartment, the second compartment sharing a wall with the first compartment, the wall forming a single surrounding enclosure of the first compartment and the second compartment;

the second compartment defining the cut-out, the cut-out having a wide slot at the wall of the cup, the wide slot transitioning to a narrow slot within the cup, the cut-out configured to receive an edge of the plate so that the cup is able to rest on the plate, the second compartment starting and ending at the wall forming the single surrounding enclosure wherein said wall defines a constant slope through the transition from first compartment to second compartment;

the second compartment comprising a solid material surrounding the cut-out, the solid material circumferentially extending to the wall underlying the closed bottom-end of the first compartment, the solid material being thicker than the closed bottom end of the first compartment, the second compartment configured so that the open top-end is substantially horizontal when the cup is sitting on a flat surface; and the plate comprising a bottom plate surface transitioning to the edge raised above the bottom plate surface, the plate configured so that a first portion of the plate beginning at the edge fits within the narrow slot within the cup and a second portion on the plate on the bottom plate surface rests within the wide slot at the wall of the cup.

3. The system of claim 2, wherein the narrow slot provides a friction fit of the first portion of the plate.

4. The system of claim 2, further comprising a friction enhancer extending upward from the wide slot, the friction enhancer configured to engage the bottom plate surface when the plate is fully inserted in the cut-out.

* * * * *